US007780463B2

(12) United States Patent
Milan

(10) Patent No.: US 7,780,463 B2
(45) Date of Patent: Aug. 24, 2010

(54) SELECTIVE FLASH MEMORY DRIVE WITH QUICK CONNECTOR

(75) Inventor: Henry Milan, 2714 Ashburton Ct., Rochester, MI (US) 48306

(73) Assignee: Henry Milan, Auburn Hills, MI (US)

( * ) Notice: Subject to any disclaimer, the term of this patent is extended or adjusted under 35 U.S.C. 154(b) by 50 days.

(21) Appl. No.: 11/931,334

(22) Filed: Oct. 31, 2007

(65) Prior Publication Data

US 2008/0293274 A1 Nov. 27, 2008

Related U.S. Application Data

(63) Continuation-in-part of application No. 11/424,599, filed on Jun. 16, 2006, now Pat. No. 7,393,224, which is a continuation-in-part of application No. 10/965,641, filed on Oct. 14, 2004, now Pat. No. 7,419,393, which is a continuation-in-part of application No. 10/328,519, filed on Dec. 23, 2002, now Pat. No. 7,004,787.

(60) Provisional application No. 60/387,796, filed on Jun. 11, 2002, provisional application No. 60/401,900, filed on Aug. 8, 2002.

(51) Int. Cl.
*H01R 29/00* (2006.01)

(52) U.S. Cl. ..... 439/171

(58) Field of Classification Search ..... 439/171, 439/513, 500, 357, 347, 296, 298, 289, 929, 439/700; 361/692, 679.3, 679.34, 679.59
See application file for complete search history.

(56) References Cited

U.S. PATENT DOCUMENTS

| | | | |
|---|---|---|---|
| 2,776,415 | A | 1/1957 | McGinley |
| 3,885,849 | A | 5/1975 | Bailey et al. |
| 4,057,310 | A | 11/1977 | Young |
| 4,310,213 | A | 1/1982 | Fetterolf, Sr. et al. |
| D295,971 | S | 5/1988 | Kikuta |
| 4,824,383 | A | 4/1989 | Lemke |
| D301,870 | S | 6/1989 | Shibano |
| 4,846,697 | A | 7/1989 | Rodgers |
| 5,119,020 | A | 6/1992 | Massey et al. |
| 5,197,900 | A | 3/1993 | Ellis et al. |
| 5,236,373 | A | 8/1993 | Kennedy |
| 5,293,013 | A | 3/1994 | Takahashi |
| 5,315,062 | A | 5/1994 | Hoshino |
| 5,370,550 | A | 12/1994 | Alwine et al. |

(Continued)

FOREIGN PATENT DOCUMENTS

DE 10031954 A1 2/2002

(Continued)

*Primary Examiner*—Edwin A. Leon
(74) *Attorney, Agent, or Firm*—Butzel Long

(57) ABSTRACT

A flash memory device having a housing for enclosing a flash memory drive, a host chip for selectively operating the flash memory drive in a host mode or a slave mode, and a control chip for controlling the operations of the flash memory device. The flash memory device further includes a universal connector mounted in the housing and configured for electrical connection to enable the connection of the flash memory device to at least one peripheral device. The flash memory device also preferably including a display screen and interface control for user operations of the device.

24 Claims, 4 Drawing Sheets

U.S. PATENT DOCUMENTS 5,425,653 A 6/1995 Koiso
5,445,534 A 8/1995 Ishizuka et al.
5,609,501 A 3/1997 McMills et al.
5,637,009 A 6/1997 Tsuji et al.
5,658,170 A 8/1997 Tan et al.
5,692,918 A 12/1997 Hill
5,772,453 A 6/1998 Tan et al.
5,772,472 A 6/1998 Beutler et al.
5,823,814 A 10/1998 Alwine
D405,053 S 2/1999 Tan et al.
5,928,342 A * 7/1999 Rossum et al. ..... 710/74
5,954,523 A 9/1999 Babcock
5,961,351 A 10/1999 Wu
5,975,954 A 11/1999 Wu et al.
6,007,380 A 12/1999 Shimoiyo
6,007,382 A 12/1999 Wu
6,010,348 A 1/2000 Alden
6,080,012 A 6/2000 Zhu et al.
6,089,879 A 7/2000 Babcock
6,155,872 A 12/2000 Wu
6,171,136 B1 1/2001 Liu et al.
6,183,292 B1 2/2001 Chen et al.
6,210,231 B1 4/2001 Lai
6,215,656 B1 4/2001 O'Neal et al.
6,217,378 B1 4/2001 Wu
6,220,872 B1 4/2001 Chen
D443,251 S 6/2001 Wang et al.
6,250,955 B1 6/2001 Archuleta
6,257,930 B1 7/2001 Yu
6,302,721 B1 10/2001 Turner et al.
6,309,255 B1 10/2001 Yu
6,334,793 B1 1/2002 Amoni et al.
6,346,002 B1 2/2002 Hsu et al.
6,358,088 B1 3/2002 Nishio et al.
6,461,181 B1 * 10/2002 Goh et al. ..... 439/289
6,466,437 B1 10/2002 Sakuragi et al.
6,532,152 B1 * 3/2003 White et al. ..... 361/692
6,637,909 B1 10/2003 Bryan
6,663,420 B1 12/2003 Xiao
6,728,108 B2 4/2004 Chen
6,908,324 B1 6/2005 Morley et al.
7,092,256 B1 * 8/2006 Salazar et al. ..... 361/737

FOREIGN PATENT DOCUMENTS

EP 1096760 A1 5/2001
EP 1100158 A2 5/2001
GB 2332103 A 6/1999
JP P2001-209460 A 3/2001

* cited by examiner 36
44
14
42
38
10
48
40
46
12
34
30
16
20
32

16
10

12
34
30
46
40
48
36
38
44
42
14

SELECTIVE FLASH MEMORY DRIVE WITH QUICK CONNECTOR

CROSS-REFERENCE TO RELATED APPLICATIONS

This application is a continuation-in-part of U.S. patent application Ser. No. 11/424,599 filed Jun. 16, 2006 now U.S. Pat. No. 7,393,224, which is a continuation-in-part of U.S. patent application Ser. No. 10/965,641 filed Oct. 14, 2004 now U.S. Pat. No. 7,419,393, which is a continuation-in-part of U.S. patent application Ser. No. 10/328,519 filed Dec. 23, 2002, now U.S. Pat. No. 7,004,787 issued Feb. 28, 2006, which claims the benefit of U.S. Provisional Patent Application Ser. No. 60/387,796, filed Jun. 11, 2002, and the benefit of U.S. Provisional Patent Application Ser. No. 60/401,900, filed Aug. 8, 2002. The above-identified applications are hereby incorporated by reference.

BACKGROUND OF THE INVENTION

The present invention relates to computers, computer peripherals, computer related devices, and other devices that may benefit from a quick and efficient method and/or system for connection to other like or different devices. More particularly, the present invention relates to a flash memory storage device that uses a universal computer cable having quick connectors and interchangeable ends for connecting the storage device to a plurality of computers, computer peripherals, computer related devices and other devices.

The fields of computers, computer peripherals, and computer related devices are rapidly expanding. All of these devices must be easily connected to one another to communicate in order to transfer data. This has caused a problem in the art due to the large number of conventional connector types and cable lengths, which are currently used. Many of these devices currently use universal serial bus (USB) or Firewire® computer architecture.

The USB architecture uses a four wire cable, or whatever the current USB specification calls for, usually in six, ten, or fifteen foot lengths, having seven different configurations possible on one end of the cable, and three different configurations possible on the other end of the cable, making possible many different configurations in each of the popular lengths of cable.

Five basic types of plugs (male) or receptacles (female) are used on the ends of the USB cables to form these configurations. These are a USB A Male, USB B Male, MiniUSB A Male and MiniUSB B Male plugs, as well as a USB A Female receptacle. Any one of these plugs or receptacles may be found on either end of a USB cable. The only limitation on the possible combinations is that an A Male USB plug is not used with a MiniUSB A Male plug, and a MiniUSB B Male plug is not used with a USB B Male plug. In addition to these five basic types of plugs, there are many other types in use due to manufacturers using their own special connectors. This makes the number of possible plugs almost uncountable; it also results in consumers having to haul around different cables for each different device.

Firewire® computer architecture uses a four or six wire cable, or whatever the current Firewire® specification calls for, usually in the same lengths as a USB cable, and having a six pin Firewire® computer connector on one or both ends of a Firewire® cable, or a four pin audio-visual connector, which also may be on one, or both, ends of a Firewire® cable, thus providing additional cable configurations.

The large number of cable configurations causes problems in the art for the computer and/or peripheral, or device manufacturer, the wholesaler, the retailer, and the user, all of whom are put to the expense of manufacturing and/or stocking and/or selling and/or buying and/or using a bewildering array of cables to connect computers and/or computer peripherals to other computers and/or computer peripherals or devices. Thus, those skilled in the art have begun to search for an easier and less costly way to accomplish these connections.

Flash memory is well known and is utilized in various portable storage devices for transferring and storing computer files and programs. Flash memory devices can operate via USB or Firewire®, but USB is the most common today. A typical flash memory device has a housing including an integral connector for connecting to a USB port on a computer. When plugged into a USB port, the computer's operating system recognizes the flash memory device as a removable drive and allows data to be retrieved from and written to the flash memory drive.

USB is a connectivity system based on having a host connected to at least one slave device. The USB host dictates the use of the USB bus and no slave device can use the bus without being connected to a host device. Therefore, connecting two USB slave devices will not allow transfer of data as there is no host device. Most flash memory devices on the market are capable of operating only as a slave device, requiring connection to a host device such as a personal computer to be used. This prevents these memory devices from being used alone with other devices such as digital cameras that are typically slave-only devices.

It is desirable to provide a flash memory drive that can accommodate a variety of interface connections and/or configurations to enable transfer of files from the flash memory drive to a variety of external devices. It is also desirable to provide a flash memory drive that can selectively operate as a host device or a slave device.

SUMMARY OF THE INVENTION

The present invention concerns a flash memory device including a housing having opposed first and second ends and opposed front and back sides; a memory drive enclosed in said housing; a host chip operably connected to said memory drive for selectively operating said flash memory drive in one of a host mode and a slave mode; a control chip enclosed in said housing and operably connected to said memory drive and said host chip for controlling the operations of said flash memory device; and a universal connector mounted in said housing and operably connected to said control chip, said universal connector being configured for electrical connection.

Preferably, the universal connector has a plurality of pins exposed at one of said ends of said housing, said pins being configured for electrical connection to a selected one of at least a first interchangeable connector and a second interchangeable connector, the first interchangeable connector having a first pin configuration for mating with said pins of said universal connector and being connected to a second pin configuration different from the first pin configuration, the second interchangeable connector having the first pin configuration for mating with said pins of said universal connector and being connected to a third pin configuration different from the first pin configuration and the second pin configuration. The second and third pin configurations are preferably pin configurations of different types of conventional connectors.

Alternatively, the universal connector has a pin receptacle to receive a plurality of pins for electrical connection to a selected one of at least a first interchangeable connector and a second interchangeable connector, the first interchangeable connector having a first pin configuration of a plurality of exposed pins for mating with said pin receptacle of said universal connector and being connected to a second pin configuration different from the first pin configuration, the second interchangeable connector having the first pin configuration for mating with said pin receptacle of said universal connector and being connected to a third pin configuration different from the first pin configuration and the second pin configuration. The second and third pin configurations are preferably pin configurations of different types of conventional connectors.

The flash memory device, according to the present invention, also preferably includes a display screen and interface controls to allow the user to interact with the device. The flash memory device may be equipped for wireless communication and may also include a speaker, a microphone, an earphone jack, and/or a radio.

DESCRIPTION OF THE DRAWINGS

The above, as well as other advantages of the present invention will become readily apparent to those skilled in the art from the following detailed description of a preferred embodiment when considered in the light of the accompanying drawings in which.

DETAILED DESCRIPTION OF THE PREFERRED EMBODIMENTS

Figure 1:
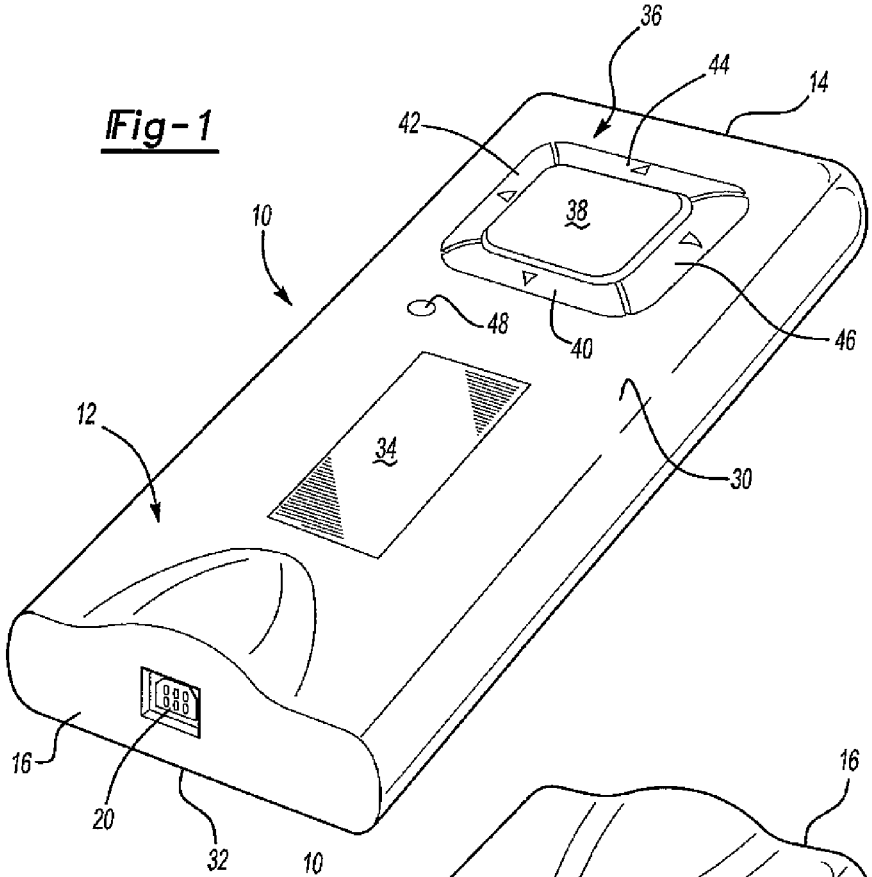
FIG. 1 is a perspective view of a flash memory storage device in accordance with the present invention.
Figure 2:
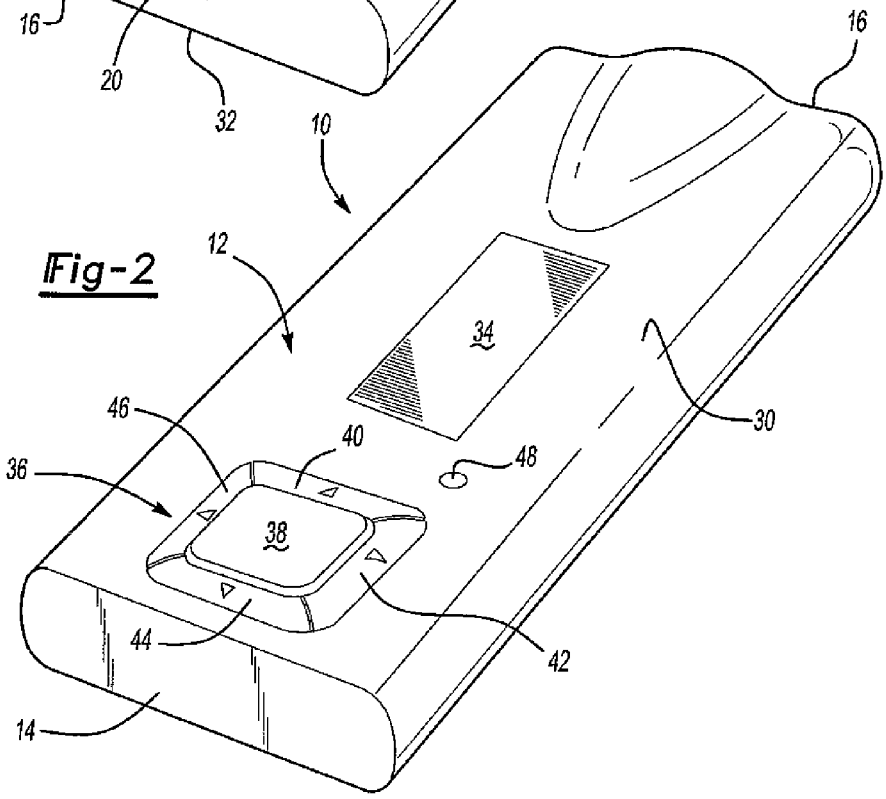
FIG. 2 is a perspective view of a flash memory storage device in accordance with the present invention.

Referring to FIGS. 1 and 2, a flash memory storage device with a quick connector in accordance with the present invention is indicated generally at 10. The flash memory device 10 includes a housing 12 having a first end 14 and an opposed second end 16. The housing 12 encases a flash memory drive 18 FIG. 3) for storage of data. Preferably, a flash memory drive 18 is selected from various commercially available flash drives well known to those skilled in the art including, but not limited to, those manufactured and/or sold by Sony®, SanDisk®, Iomega®, Lexar®, Verbatim®, Targus®, and the like. The total amount of available flash memory storage capacity may range, but is not limited to, from 64 megabytes (MB) of data storage to upwards of 32 gigabytes (GB). Those skilled in the art, however, will appreciate that memory amounts are rapidly increasing and that the amount of memory storage may be chosen for a specification application or desired use while remaining within the scope of the present invention.

The second end 16 of the housing 12 includes a universal connector 20 for connecting the flash memory device 10 to another device (not shown) such as a computer, MP3 player, printer, scanner, digital camera, etc. The connector 20 is electronically connected to the flash memory drive 18 in the housing 12. The universal connector 20 is contemplated to be used with interchangeable cords, plugs, ends, connectors, and the like to enable the flash memory device to be connected to a plurality of devices. While the universal connector can be adapted to accommodate a variety of universal connection systems now known or developed in the future, the preferred embodiment of the present invention utilizes the quick connector system with interchangeable ends as disclosed in copending U.S. patent application Ser. No. 10/965,641 (the "parent application").

Without going outside the scope of the present invention, the universal connector 20 can take many shapes and forms. For example, the universal connector 20 could be a male-type connector (not shown) instead of a female-type connector. Alternatively, a converter (not shown) could be used to enable the universal connector 20 to be made compatible with another universal connector set now known or developed in the future.

The use of a universal connector set having interchangeable cords, plugs, ends, and connectors advantageously allows the flash memory device 10 to be configured in a plurality of conventional connector configurations, depending on the needs of the user. For example, when a 4-Pin USB Series "A" plug (not shown) is attached to the universal connector 20 of the flash memory device 10, the device is advantageously operable to connect to a computer (not shown) or a hub (not shown) having the corresponding conventional USB port. When the universal connector 20 of the flash memory device 10 is engaged with the USB port (not shown) in the computer, the operating system of the computer will recognize the flash memory drive 18 as a removable drive and allow data to be retrieved from and written to the flash memory storage.

Similarly, when a 4-Pin USB Series "B" plug (not shown) is attached to the universal connector 20 of the flash memory device 10, the device is advantageously operable to connect to a printer (not shown), a scanner (not shown) or a CD/DVD drive (not shown). Similarly, when a 5-Pin USB Mini "A" plug (not shown) is attached to the connector 20 of the flash memory device 10, the device is advantageously operable to connect to a PDA (not shown), a cell phone (not shown), or a MP3 player (not shown). Similarly, when a 4-Pin USB-"Mini-B" plug (not shown) is attached to the connector 20 of the flash memory device 10, the device is advantageously operable to connect to the PDA, a digital camera (not shown) or the MP3 player.

It is clear that the inclusion of the universal connector 20 that can be used with a plurality of interchangeable connectors (not shown) advantageously allows the flash memory device 10 to be configured for connection to a number of devices as described above depending on the needs of the user. While the above examples all relate to USB, this disclosure also anticipates the use of Firewire® or any other types of communication system now known or developed in the future.

Figure 3:
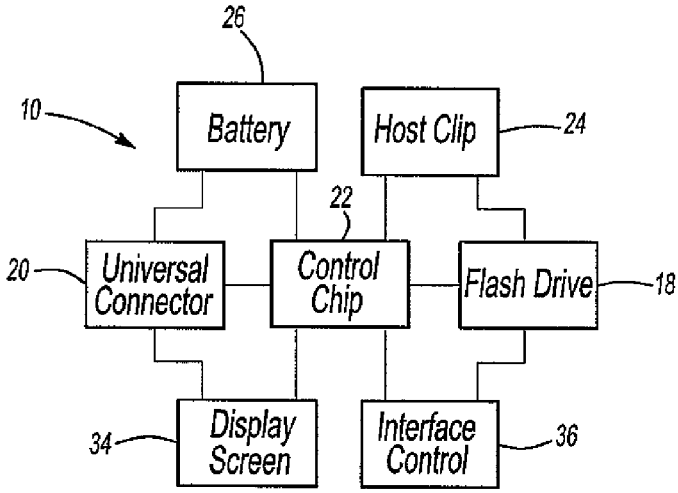
FIG. 3 is a schematic block diagram of the flash memory device in accordance with the present invention.

Referring now to FIG. 3, the flash memory drive 18 further includes a control chip 22 encased by the housing 12. The control chip 22 is electronically connected to the flash memory drive 18 and the universal connector 20. The control chip 22 operates as the control for the flash memory device 10, controlling all function of the flash memory device 10, including managing input and output operations. Most USB flash drives on the market operate only as USB slave devices, requiring connection to a host device—usually a computer—for operation. The host device controls the transfer and deletion of files as the slave device cannot perform such functions without a host. The flash memory device 10 further includes a host chip 24 encased by the housing 12 and operably connected to the control chip 22, thereby enabling the flash memory device 10 to operate as a host if needed. The ability to selectively operate the flash memory device 10 as a host device allows the device 10 to be used to browse, transfer, and erase files without the need for a host device such as a computer. This allows the flash memory device to be used in conjunction with peripherals such as digital cameras and MP3 players which are usually slave-only devices.

The housing 12 of the flash memory device 10 also encases a battery 26 electronically connected to the control chip 22 and universal connector 20 for supplying power to the flash memory device 10. The battery 26 is chargeable when the flash memory device 10 is connected to a powered port such as a USB port on a personal computer via the universal connector 20. While an 850 mA Li-Polymer battery with a width of 35 mm is contemplated for use in the preferred embodiment, one skilled in the art will recognize that a variety of types and sizes of batteries may be used without varying from the scope of the invention.

Referring back to FIG. 1, the housing 12 of flash memory device 10 has a front side 30 and an opposite back side 32, separated by the first end 14 and the second end 16. The front side 30 includes a display screen 34 and at least one interface control shown generally at 36. Preferably, the interface control 36 is located between the second end 16 of the housing 12 and the display screen 34. However, one skilled in the art will recognize that multiple arrangements of the display screen 34 and interface control 36 on the front side 30 of the flash memory device 10 are possible without straying from the scope of the present invention.

Both the display screen 34 and the interface control 36 are electronically connected to the control chip 22. The control chip 22 receives input via the interface control 36 and controls output to the display screen 34. Preferably the display screen 34 is an LCD display capable of display at least 132×32 dot matrix information. One skilled in the art will appreciate that a variety of types, sizes, and resolutions of screens may be used and still be within the scope of the present invention.

The interface control 36 is preferably substantially square in shape and sized for easy use by the user's thumb or similar appendage. Preferably, the interface control 36 serves all of the input/selection functions needed for operation of the flash memory device 10. These functions may include, but are not limited to, powering the device on and off, navigation through menus to choose/highlight options and files, and selecting certain operations/files.

Figure 5:
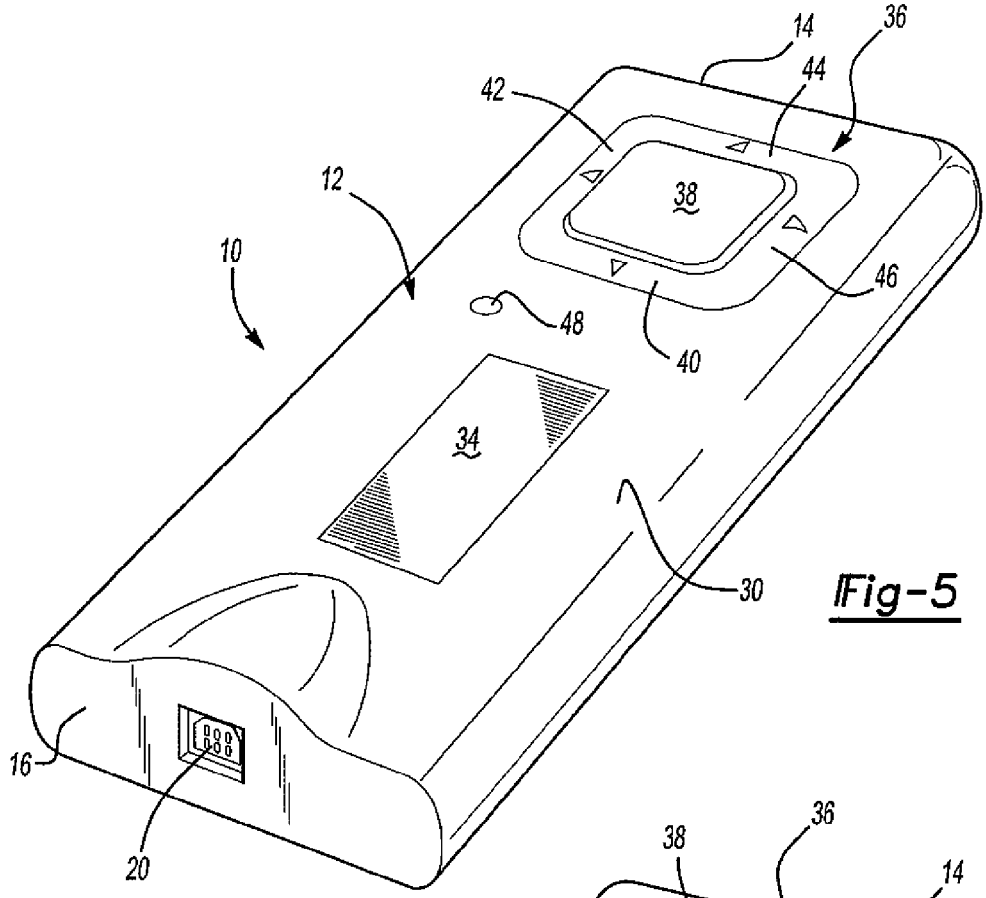
FIG. 5 is a perspective view of an alternate embodiment of a flash memory storage device in accordance with the present invention.

As shown in FIG. 1, the interface control 36 preferably includes a center button 38 and four directional buttons, although any number and arrangement of buttons is possible. The four directional buttons include an up button 40, a right button 42, a down button 44, and a left button 46 arranged around the center button 38 in the direction respective of their name. To clarify, when the flash memory device 10 is in an upright position, the up button 40 is situated above the center button 38, the right button 42 is situated to the right of the center button 38, and so on. The buttons 38, 40, 42, 44, 46 may be separate as shown in FIG. 1 or in the alternative they may be one solid piece (FIG. 5), without separation between the directional buttons 40, 42, 44, 46, that tilts or rocks.

Figure 6:
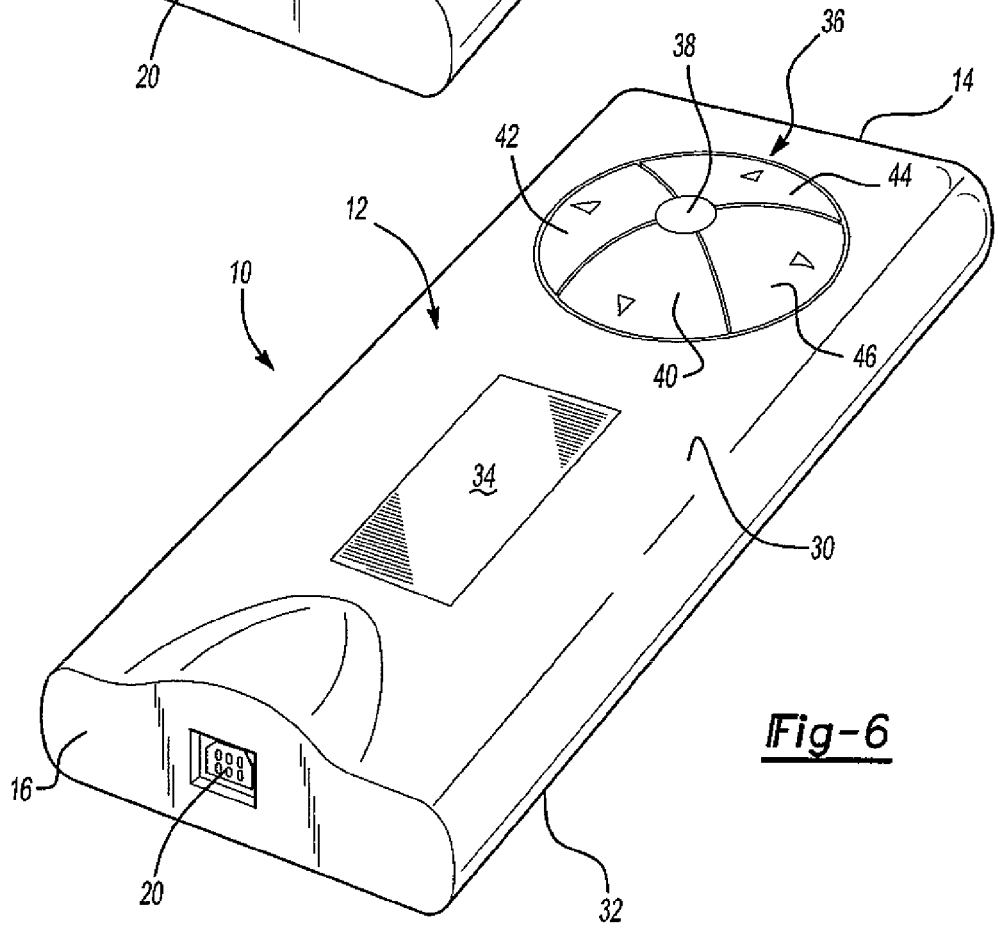
FIG. 6 is a perspective view of an alternate embodiment of a flash memory storage device in accordance with the present invention.
Figure 7:
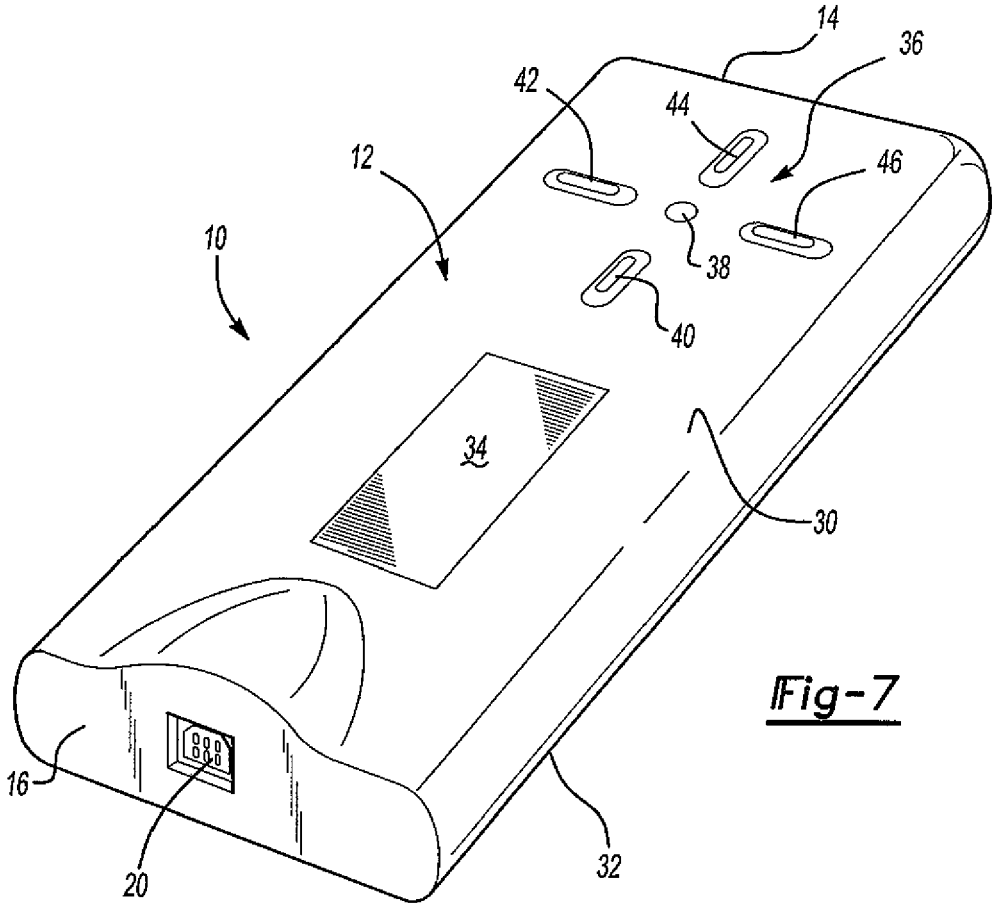
FIG. 7 is a perspective view of an alternate embodiment of a flash memory storage device in accordance with the present invention.

There are numerous possible configurations of the interface control 36. For example, as shown in FIG. 6 the interface control 36 could be substantially circular instead of square. Alternatively, the interface control 36 could be comprised of multiple buttons arranged in many configurations, one such example is shown in FIG. 7. Or, the interface control 36 could be located on side of the flash memory device (not shown). In yet another alternative embodiment, the interface control 36 may incorporate one or more touch pads. For example, the center button 38 could be a touch pad instead of a button. One skilled in the art will appreciate the many shapes and types of interface controls that could be used without straying from the scope of this invention.

Figure 4:
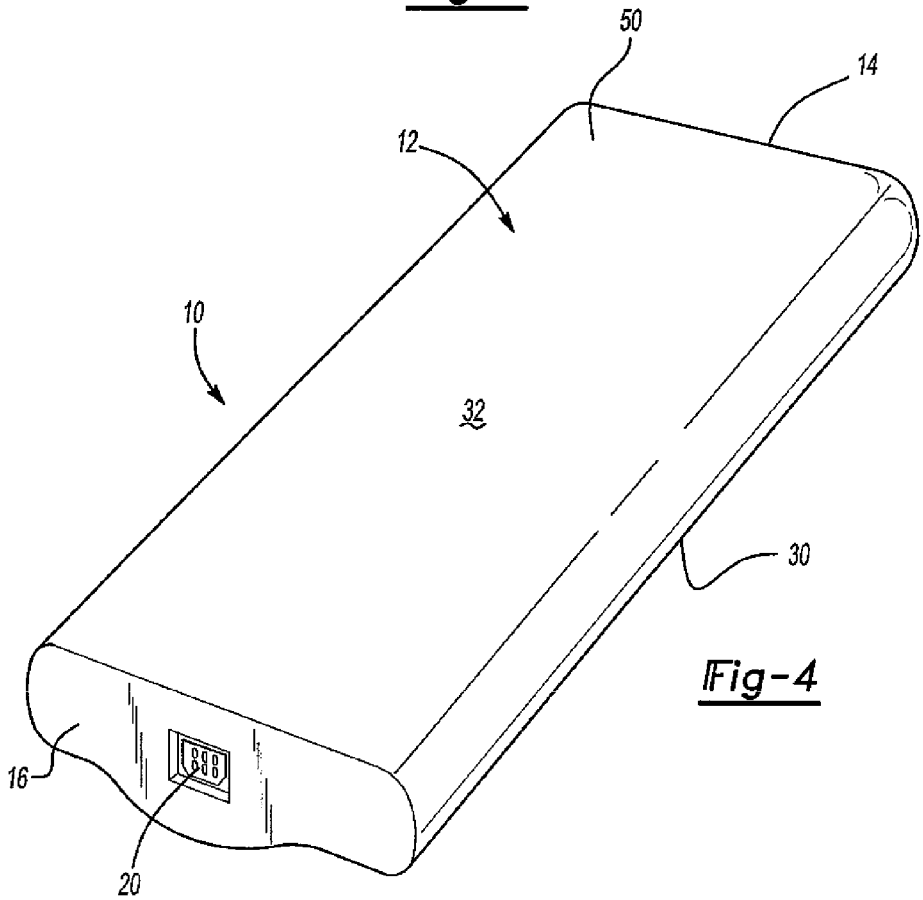
FIG. 4 is a perspective view of a flash memory storage device in accordance with the present invention.

The preferred embodiment of the present invention further includes a power button 48 located on the front side 30 of the flash memory device 10 and a reset button 50 located on the back side 32 (FIG. 4). The placement of the power button 48 and reset button 50 in the Figures is for illustrative purposes, as placement of either anywhere on the housing 12 is within the scope of the invention. The power button 48 is operably connected to the battery 26 and control chip 22 for turning the flash memory device 10 on and off. Alternatively, the flash memory device 10 could not include a separate power button 48 and instead utilize the interface control 36 to control the power functions of the flash memory device 10.

The reset button 50 is operably connected to the control chip 22 and upon engagement, sets the flash memory device 10 back to its original state. The reset button 50 might be used in situations where the flash memory device 10 freezes up, doesn't operate correctly, or when the user simply wants to return the device to its factory state.

Figure 8:
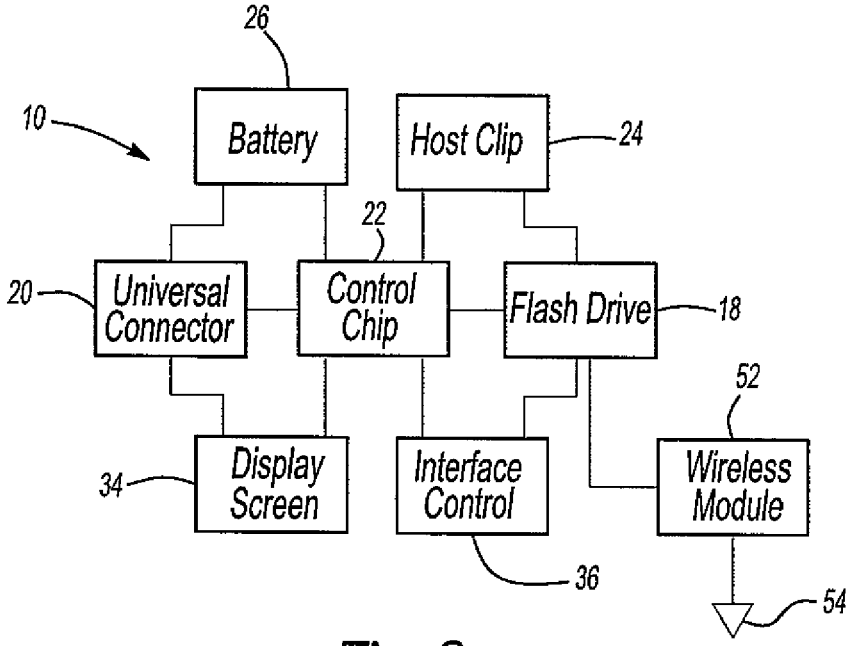
FIG. 8 is a schematic block diagram of an alternate embodiment of a flash memory device in accordance with the present invention.

Referring now to FIG. 8, in an alternate embodiment of the present invention, the flash memory device 10 is adapted to wirelessly communicate with other wireless capable devices. The housing 12 of the flash memory device 10 includes a wireless module 52 operably connected to the control chip 22 for transferring data with another wireless capable device (not shown). The wireless protocol may require the use of an antenna or similar signal sending/receiving element. In such case, an antenna 54 is connected to the wireless module 52 to send and receive wireless communications. The antenna 54 may be visible (not shown) on the housing 12 of the flash memory device 10. Alternatively the antenna 54 may be completely encased by the housing 12. The wireless module 52 preferably operates the Bluetooth standard, but one skilled in the art will realize that any other means of wireless communication now existing (such as RF) or invented in the future may be used without going outside the scope of this disclosure.

There are numerous additions and modifications that can be made to the invention as disclosed herein without departing from the spirit or scope of the instant invention. While none of these elements are shown in the Figures, a microphone, speakers, radio, and/or headphone jack could be added to the present invention. This list is not intended to be limiting, but instead illustrative of additions that are within the scope of this disclosure.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A flash memory device comprising:

a housing having opposed first and second ends and opposed front and back sides;

a flash memory drive enclosed in said housing, said flash memory drive selectively operable in one of a host mode and a slave mode;

wherein the host mode enables the flash memory device to operate as a host device when connected to a slave mode operating device, and wherein the slave mode enables the flash memory device to operate as a slave device when connected to a host mode operating device;

a host chip operably connected to said flash memory drive for selectively operating said flash memory drive in one of a host mode and a slave mode;

a control chip enclosed in said housing and operably connected to said memory drive and said host chip for controlling the operations of said flash memory device; and a universal connector permanently mounted in said housing and operably connected to said control chip, said universal connector providing separate electrical connectivity to at least one of a first interchangeable connector and a second interchangeable connector to interconnect the flash memory device with a second device.

2. The flash memory device according to claim 1, wherein said universal connector has a plurality of pins exposed at one of said ends of said housing, said pins being configured for electrical connection to a selected one of at least a first interchangeable connector and a second interchangeable connector, the first interchangeable connector having a first pin configuration for mating with said pins of said universal connector and being connected to a second pin configuration different from the first pin configuration, the second interchangeable connector having the first pin configuration for mating with said pins of said universal connector and being connected to a third pin configuration different from the first pin configuration and the second pin configuration.

3. The flash memory device according to claim 2, wherein the second and third pin configurations are pin configurations of different types of conventional connectors.

4. The flash memory device according to claim 1, wherein said universal connector has a pin receptacle to receive a plurality of pins for electrical connection to a selected one of at least a first interchangeable connector and a second interchangeable connector, the first interchangeable connector having a first pin configuration of a plurality of exposed pins for mating with said pin receptacle of said universal connector and being connected to a second pin configuration different from the first pin configuration, the second interchangeable connector having the first pin configuration for mating with said pin receptacle of said universal connector and being connected to a third pin configuration different from the first pin configuration and the second pin configuration.

5. The flash memory device according to claim 4, wherein the second and third pin configurations are pin configurations of different types of conventional connectors.

6. The flash memory device according to claim 1, wherein one of said front side and back side of said housing includes a display screen for displaying flash memory device information.

7. The flash memory device according to claim 1, wherein one of said front side and back side of said housing includes at least one interface control for providing user interaction with said flash memory device.

8. The flash memory device according to claim 1, wherein said housing further encloses a battery for powering said flash memory device.

9. The flash memory device according to claim 1, further including a power button mounted in said housing.

10. The flash memory device according to claim 1, further including a reset button mounted in said housing.

11. The flash memory device according to claim 1, wherein said flash memory device further includes a wireless module enclosed in said housing for providing said flash memory device with wireless communication capability.

12. The flash memory device according to claim 7 wherein one of said at least one interface control is a touch pad.

13. The flash memory device according to claim 1 further including at least one of a speaker, a microphone, a headphone jack, and a radio.

14. A flash memory device comprising:

a housing having opposed first and second ends and opposed front and back sides;

a flash memory drive enclosed in said housing, said flash memory drive selectively operable in one of a host mode and a slave mode;

wherein the host mode enables the flash memory device to operate as a host device when connected to a slave mode operating device, and wherein the slave mode enables the flash memory device to operate as a slave device when connected to a host mode operating device;

a host chip operably connected to said flash memory drive for selectively operating said flash memory drive in one of a host mode and a slave mode;

a control chip enclosed in said housing and operably connected to said flash memory drive and said host chip for controlling the operations of said flash memory device;

a display screen operably connected to said control chip for displaying flash memory device information;

at least one interface control operably connected to said control chip for providing interaction with said flash memory device;

a universal connector permanently mounted in said housing and operably connected to said control chip, said universal connector providing separate electrical connectivity to at least one of a first interchangeable connector and a second interchangeable connector to interconnect the flash memory device with a second device; and a battery enclosed in said housing for providing power to said flash memory device.

15. The flash memory device according to claim 14, wherein said universal connector has a plurality of pins exposed at one of said ends of said housing, said pins being configured for electrical connection to a selected one of at least a first interchangeable connector and a second interchangeable connector, the first interchangeable connector having a first pin configuration for mating with said pins of said universal connector and being connected to a second pin configuration different from the first pin configuration, the second interchangeable connector having the first pin configuration for mating with said pins of said universal connector and being connected to a third pin configuration different from the first pin configuration and the second pin configuration.

16. The flash memory device according to claim 15, wherein the second and third pin configurations are pin configurations of different types of conventional connectors.

17. The flash memory device according to claim 14, wherein said universal connector has a pin receptacle to receive a plurality of pins for electrical connection to a selected one of at least a first interchangeable connector and a second interchangeable connector, the first interchangeable connector having a first pin configuration of a plurality of exposed pins for mating with said pin receptacle of said universal connector and being connected to a second pin configuration different from the first pin configuration, the second interchangeable connector having the first pin configuration for mating with said pin receptacle of said universal connector and being connected to a third pin configuration different from the first pin configuration and the second pin configuration.

18. The flash memory device according to claim 17, wherein the second and third pin configurations are pin configurations of different types of conventional connectors.

19. The flash memory device according to claim 14, further including a power button mounted in said housing.

20. The flash memory device according to claim 14, further including a reset button mounted in said housing.

21. The flash memory device according to claim 14, wherein said flash memory device further includes a wireless module enclosed in said housing for providing said flash memory device with wireless communication capability.

22. The flash memory device according to claim 14 wherein one of said at least one interface control is a touch pad.

23. The flash memory device according to claim 14 further including at least one of a speaker, a microphone, a headphone jack, and a radio.

24. A flash memory device comprising:

a housing having opposed first and second ends and opposed front and back sides;

a flash memory drive enclosed in said housing, said flash memory drive selectively operable in one of a host mode and a slave mode;

wherein the host mode enables the flash memory device to operate as a host device when connected to a slave mode operating device, and wherein the slave mode enables the flash memory device to operate as a slave device when connected to a host mode operating device;

a host chip operably connected to said flash memory drive for selectively operating said flash memory drive in one of a host mode and a slave mode;

a control chip enclosed in said housing and operably connected to said memory drive and said host chip for controlling the operations of said flash memory device;

a universal connector permanently mounted in said housing and operably connected to said control chip, said universal connector providing separate electrical connectivity to at least one of a first interchangeable connector and a second interchangeable connector to interconnect the flash memory device with a second device; and wherein said universal connector has a plurality of pins exposed at one of said ends of said housing, said pins being configured for electrical connection to a selected one of at least a first interchangeable connector and a second interchangeable connector, the first interchangeable connector having a first pin configuration for mating with said pins of said universal connector and being connected to a second pin configuration different from the first pin configuration, the second interchangeable connector having the first pin configuration for mating with said pins of said universal connector and being connected to a third pin configuration different from the first pin configuration and the second pin configuration.

* * * * *